US007340783B2

(12) United States Patent
Leaphart, Jr. et al.

(10) Patent No.: US 7,340,783 B2
(45) Date of Patent: Mar. 11, 2008

(54) COMPRESSED AIR DRAIN OPENING DEVICE

(75) Inventors: J. Kirk Leaphart, Jr., 302 Jonesville Rd. H-7, Simpsonville, SC (US) 29681; C. Mark Leaphart, 302 Jonesville Rd. H-7, Simpsonville, SC (US) 29681; Carlos R. Schoolcraft, Middleton, OH (US); Michael L. Ernst, Milford, OH (US)

(73) Assignees: J. Kirk Leaphart, Jr., Simpsonville, SC (US); C. Mark Leaphart, Simpsonville, SC (US)

( * ) Notice: Subject to any disclaimer, the term of this patent is extended or adjusted under 35 U.S.C. 154(b) by 449 days.

(21) Appl. No.: 10/739,417

(22) Filed: Dec. 18, 2003

(65) Prior Publication Data

US 2005/0132479 A1 Jun. 23, 2005

Related U.S. Application Data

(63) Continuation-in-part of application No. 10/436,515, filed on May 13, 2003, now Pat. No. 6,862,753, which is a continuation-in-part of application No. 10/322,920, filed on Aug. 22, 2002, now Pat. No. 6,789,276, which is a continuation-in-part of application No. 09/850,275, filed on May 7, 2001, now Pat. No. 6,484,326, and a continuation-in-part of application No. 29/195,365, filed on Dec. 10, 2003, now Pat. No. Des. 499,293.

(51) Int. Cl.
*E03D 9/00* (2006.01)

(52) U.S. Cl. ..... 4/255.02; 4/255.11

(58) Field of Classification Search ..... 4/255.01, 4/255.11; 206/349
See application file for complete search history.

(56) References Cited

U.S. PATENT DOCUMENTS

| | | | | | |
|---|---|---|---|---|---|
| 886,353 | A | | 5/1908 | Darling | 4/255.03 |
| 1,154,055 | A | | 9/1915 | Reeves | 4/255.12 |
| 1,684,880 | A | | 9/1928 | Norton | 4/255.02 |
| 1,706,315 | A | | 3/1929 | Norton | 4/255.02 |
| 2,697,842 | A | | 12/1954 | Meyer | 4/255.02 |
| 3,934,280 | A | | 1/1976 | Tancredi | 4/255.02 |
| 4,096,597 | A | | 6/1978 | Duse | 4/255.01 |
| 4,186,451 | A | | 2/1980 | Ruo | 4/255.02 |
| D292,631 | S | | 11/1987 | Tash | D32/14 |
| 4,813,343 | A | * | 3/1989 | Schaefer | 92/245 X |
| 5,199,114 | A | | 4/1993 | Christopher | 4/255.02 |
| 5,305,882 | A | * | 4/1994 | Kaplan et al. | 206/349 |
| D364,251 | S | | 11/1995 | Novak | D32/35 |
| 5,522,094 | A | | 6/1996 | Balazs | 4/255.02 |

(Continued)

FOREIGN PATENT DOCUMENTS

| | | | |
|---|---|---|---|
| FR | 2371588 | 6/1978 | 4/255.01 |

*Primary Examiner*—Robert M. Fetsuga
(74) *Attorney, Agent, or Firm*—Joseph T. Guy; Nexsen Pruet, LLC

(57) ABSTRACT

An air plunger is described. The air plunger comprises an upper barrel and a lower barrel slidably received by the upper barrel. An air seal is fixed to the lower barrel and slidably engages with the upper barrel. A nozzle is attached to the lower barrel opposite to the upper barrel. A stop mechanism prohibits the upper barrel from disassociating with the lower barrel.

8 Claims, 19 Drawing Sheets

U.S. PATENT DOCUMENTS 5,940,897 A 8/1999 James ..... 4/255.02
D450,964 S * 11/2001 Johnson ..... D6/524
6,484,326 B1 11/2002 Leaphart et al. ..... 4/255.02
6,719,134 B2 * 4/2004 Phillips et al. ..... 206/349
6,789,276 B2 * 9/2004 Leaphart et al. ..... 4/255.01 X
D499,293 S * 12/2004 Ernst et al. ..... D6/551
6,862,753 B2 * 3/2005 Leaphart et al. ..... 4/255.11 X

* cited by examiner

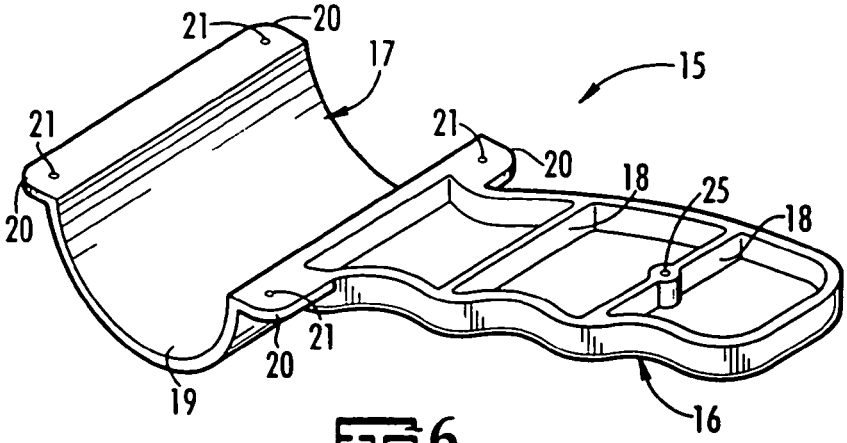
FIG.6
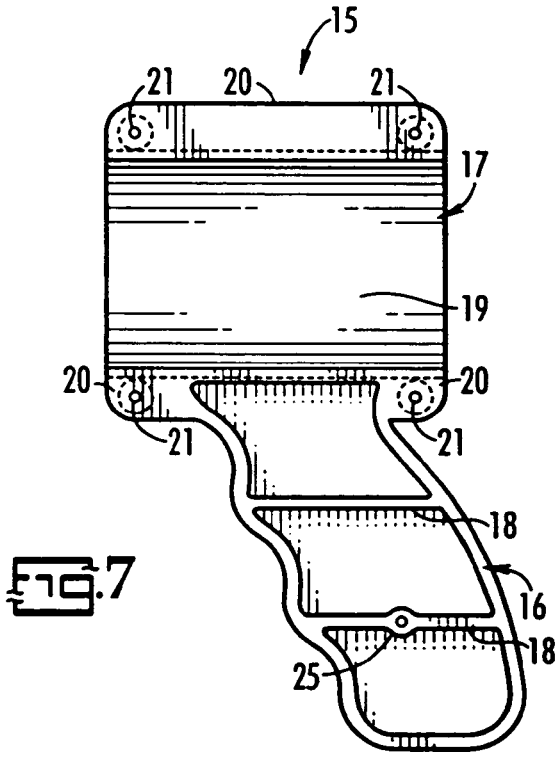
FIG.7
FIG.8
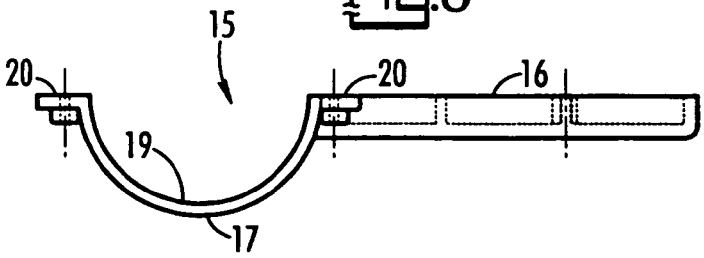

COMPRESSED AIR DRAIN OPENING DEVICE

RELATED APPLICATION

The present application is a continuation-in-part of U.S. patent application Ser. No. 10/436,515, filed May 13, 2003 now U.S. Pat. No. 6,862,753 which, in turn, is a continuation-in-part of U.S. patent application Ser. No. 10/322,920, filed Aug. 22, 2002 now U.S. Pat. No. 6,789,276 which, in turn, is a continuation-in-part of U.S. patent application Ser. No. 09/850,275, filed May. 7, 2001, now U.S. Pat. No. 6,484,326. The present application is a continuation-in-part of U.S. patent application Ser. No. 29/195,365 filed Dec. 10, 2003, now U.S. Pat. No. D499,293.

TECHNICAL FIELD

The present invention is related to an improved drain opening device which utilizes compressed air to free a clogged drain.

BACKGROUND

Water drains typically clog due to materials becoming lodged in the traps, joints or other locations. Typically, a clog can be freed by applying pressure on the upper extent of the drain. There are a multitude of devices available for applying pressure yet they are all deficient in one manner or another.

Devices commonly referred to as "plungers" comprise a force cup with a handle attached thereto. The force cup is brought into contact with the drain entrance and pushed down by the handle thereby forcing water to contact the clog with pressure. A force cup device typically does not have a sufficient volume to apply enough pressure on the clog to be effective. Exemplary force cup devices are disclosed in U.S. Pat. Nos. 1,706,315; Des. 364,251 and Des. 292,631. The low pressure exerted by force cup devices has led to the development of other types of devices.

Piston devices comprising a piston slidably received within a cylinder are an improvement over force cup devices. The piston devices typically comprise a fixed tube with a piston that transits therein to apply pressure at the exit end of the tube. Examples include U.S. Pat. Nos. 1,684,880; 3,934,280; 4,186,451; 5,199,114; 5,522,094 and 5,940,897. These devices are often adequate for unclogging drains yet they require many parts and multiple seals thereby increasing the cost of manufacture and the susceptibility of failure. Each piston must have a seal between the piston and the outer tube to be effective. The piston must also be sealed to the push rod. Furthermore, the upper end of the tube must have a leak to allow air to enter above the piston to avoid a pressure decrease above the piston which would work against the downward force. These devices, while functional, have yet to receive widespread acceptance over the plunger.

A telescoping tube drain opening device is disclosed in U.S. Pat. No. 4,096,597. The telescoping tube drain opening device utilizes water as a pressure source and has an internal membrane incorporated in the upper tube. This device has several deficiencies. The use of water to dislodge the elements clogging a drain causes additional problems. First, it is not uncommon for the sink, or toilet, to be close to full when the effort to dislodge the clog is initiated. If a water source is used the additional water may cause the sink, or toilet, to overflow which is highly undesirable. It is not uncommon for the unclogging operation to have to be repeated which further exasperates the problem of adding additional water to the clogged appliance. If water from the clogged device is used the spoiled water is drawn into the telescoping tubes which causes problems such as trapped bacteria and other oderiferous material. The flap valve is also a point of deficiency. If water is carried from a separate source the flap valve is prone to leaking. Furthermore, after the water is discharged the flap valve will no longer be under pressure and will therefore seal with some amount of spoiled water trapped therein.

There has been a long felt desire in the art for a device suitable for unclogging drains which is economical, efficient and sanitary.

SUMMARY

It is an object of the present invention to provide a device for unclogging drains which is economical to manufacture.

It is another object of the present invention to provide a device for unclogging drains which can provide a high pressure directly to the clog and drain.

A particular feature of the present invention is the reliance on minimal moving parts and the simplicity of operation.

Yet another feature of the present invention is the cleanliness of the apparatus since spoiled water cannot be easily trapped in the interior of the device.

These and other advantages, as will be realized, are provided in an air plunger. The air plunger comprises an upper barrel and a lower barrel slidably received by the upper barrel. An air seal is fixed to the lower barrel and slidably engages with the upper barrel. A nozzle is attached to the lower barrel opposite to the upper barrel. A stop mechanism prohibits the upper barrel from disassociating with the lower barrel.

Another embodiment is provided in a compressed air plunger. The compressed air plunger comprises an upper barrel and a lower barrel slidably received by the upper barrel. A force handle is attached to the upper barrel. A nozzle engages with the drain. When the force handle is pushed towards the nozzle air pressure is exerted on the drain.

Yet another embodiment of the present invention is provided in a storable apparatus for unclogging a drain. The apparatus comprises an air plunger comprising an upper barrel; a lower barrel slidably received by the upper barrel and a nozzle which engages with the drain. The holder comprises a protrusion which is receivable in the nozzle.

BRIEF DESCRIPTION OF THE DRAWINGS

FIG. 6 is a perspective view of a preferred alignment handle blank of the present invention.

FIG. 7 is a top view of the alignment handle blank of FIG. 6.

FIG. 8 is a side view of the alignment handle blank of FIG. 6.

DETAILED DESCRIPTION

The invention will be described with reference to the drawings wherein similar elements are numbered accordingly.

Figure 1:
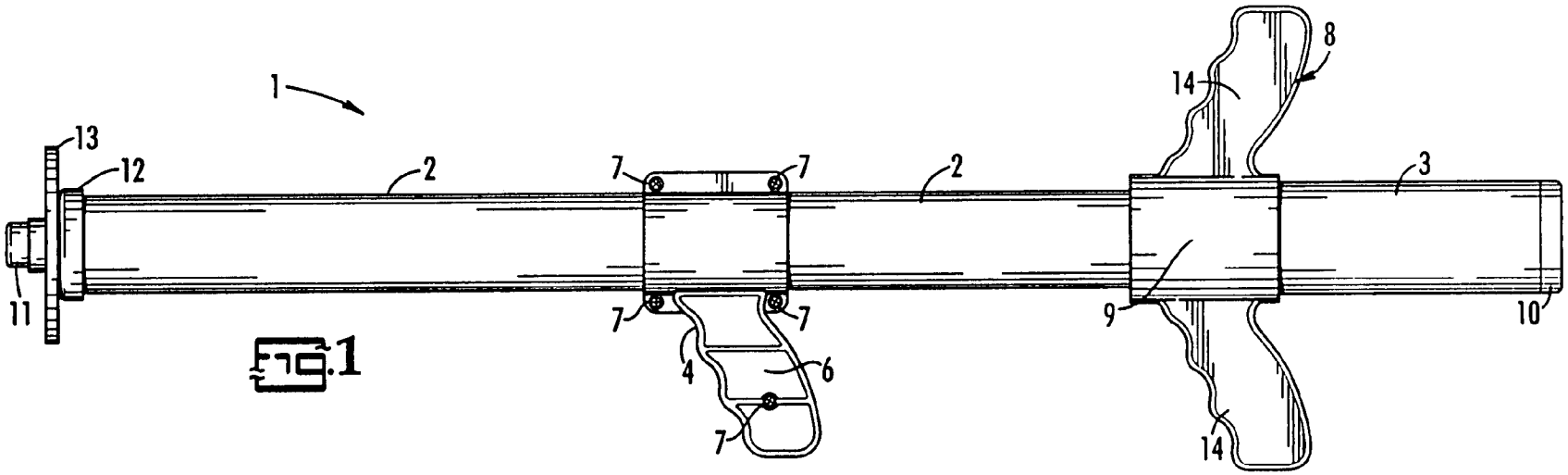
FIG. 1 is a side view of an embodiment of the compressed air plunger.

A compressed air plunger of the present invention, generally represented at 1, is shown in side view in FIG. 1. The compressed air plunger, 1, comprises a lower barrel, 2, and an upper barrel, 3, which slidably receives the lower barrel therein. Attached circumferentially to the lower barrel, 2, is a preferred alignment handle, 4. The alignment handle, 4, preferably comprises a collar, 5, with an alignment grip, 6, integral thereto. The alignment handle, 4, is preferably two matching components secured together with attachment elements, 7, as will be further described herein. The alignment handle may also be integral to the lower barrel. Attached circumferentially to the upper barrel, 3, is preferably a force handle, 8. The force handle, 8, comprises a collar, 9, with a pair of force grips, 14, integral thereto and preferably arranged symmetrical about the central axis of the compressed air plunger, 1. The upper end of the upper barrel preferably comprises a cap, 10, which seals the upper barrel. The lower end of the lower barrel comprises a spout, 11, with an attachment collar, 12, integral thereto. A seal disk, 13, receives the spout, 11. In operation, the user places one hand on a force grip, 14, and the other hand on the alignment grip, 6. The spout, 11, of the compressed air plunger is brought into close proximity of the drain. Once in the proper position, as would be apparent to one of ordinary skill in the art, the hand on the alignment grip is placed on the vacant force grip, 14. As the force grips are pressed downward towards the alignment handle, 4, the seal disk, 13, conforms with and seals the drain opening and air is forced from the variable volume cylinder formed by the combined upper barrel and lower barrel through the spout and into the clogged drain pipe. The pair of force grips, 14, insures that the pressure can be applied evenly without danger of displacing the compressed air plunger to one side or the other thereby allowing a substantial amount of force to be applied to the clogged drain safely.

Figure 2:
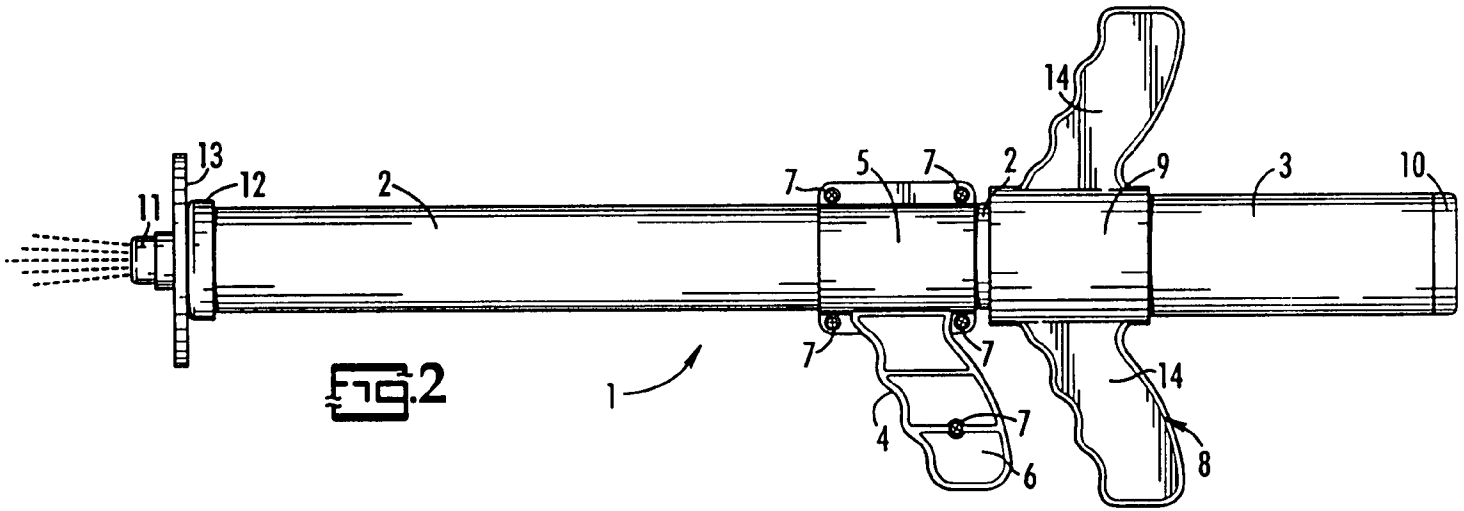
FIG. 2 is a side view of the embodiment of the compressed air plunger of FIG. 1 after discharge of the air to create pressure in the drain.

A side view of the compressed air plunger after expelling the air from the nozzle is shown in FIG. 2. In FIG. 2 the force grips, 14, and associated collar, 9, have been pushed downward towards the alignment handle, 4. The upper barrel, 3, which is attached to the collar, 9, of the force grip, 8, follows with the alignment handle. As would be apparent from the description herein, and illustrations, the pressure is created by the volume of air displaced in the combined barrels.

Figure 3:
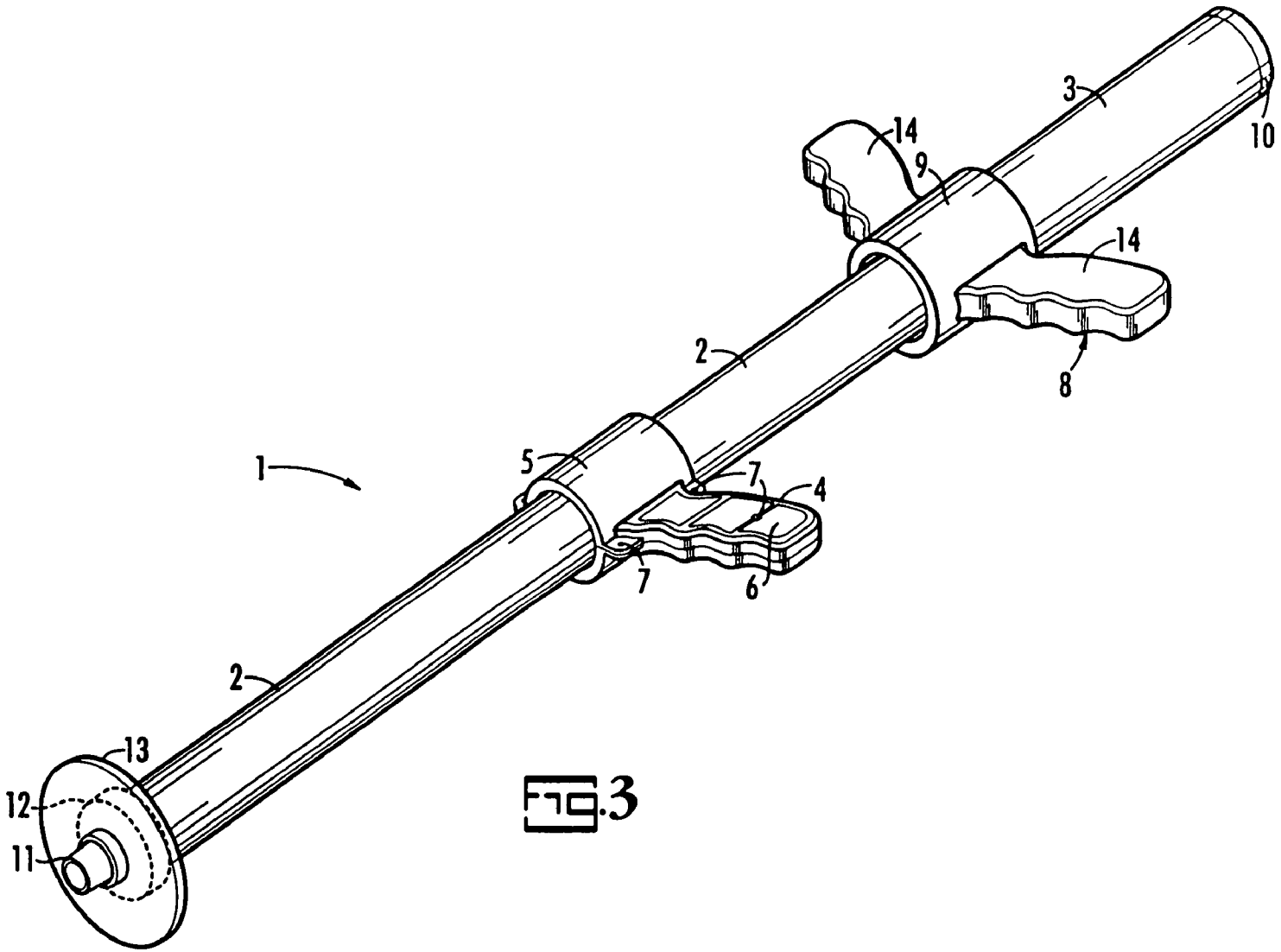
FIG. 3 is a front perspective view of the embodiment of the compressed air plunger of FIG. 1.

FIG. 3 is a front perspective view of the compressed air plunger of FIG. 1. In FIG. 3 the seal disk and nozzle can be more readily visualized.

Figure 4:
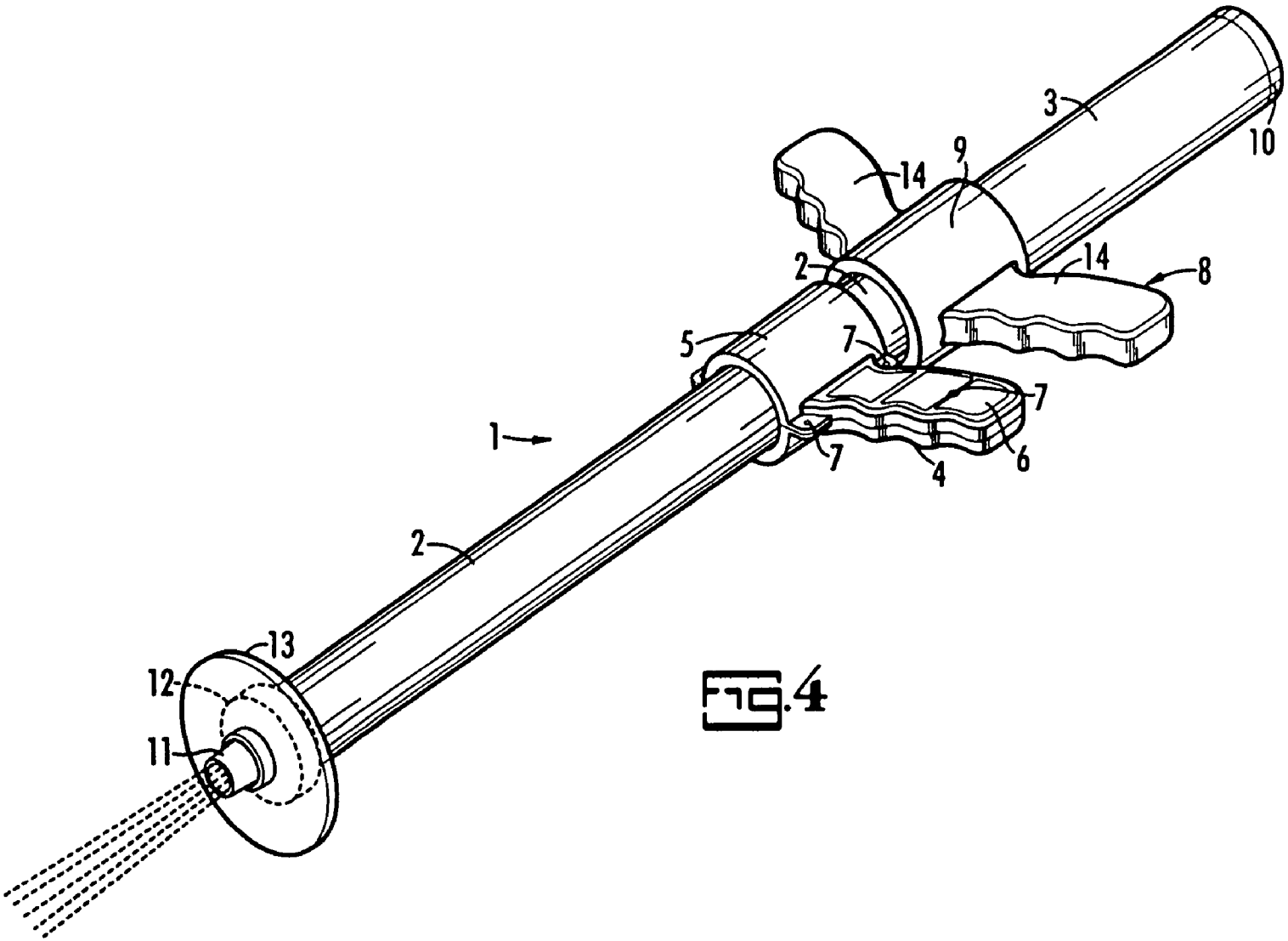
FIG. 4 is a front perspective view of the embodiment of the compressed air plunger of FIG. 3 after discharge of the air to create a pressure in the drain.

FIG. 4 is a front perspective view of the compressed air plunger of FIG. 2 after the upper barrel has been moved to a position which decreases the total volume in the variable volume cylinder thereby forcing air out of the nozzle.

Figure 5:
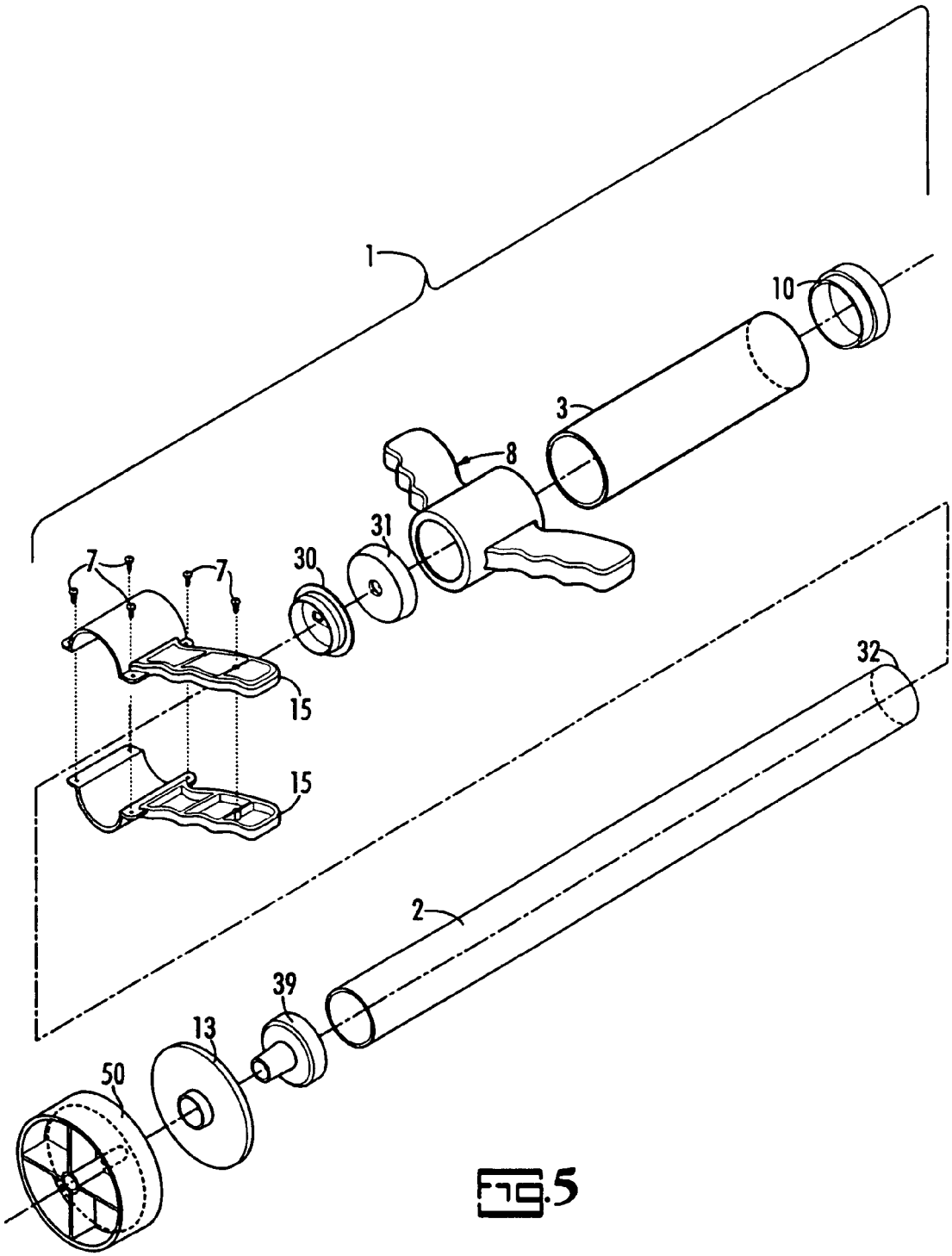
FIG. 5 is an exploded view of an embodiment of the compressed air plunger of FIG. 1.

An exploded perspective view of an embodiment of the present invention is provided in FIG. 5.

In FIG. 5 the lower barrel, 2, is shown as a preferred hollow cylinder. Other shapes, such a trigonal, square, pentagon, hexagon, and polygonal may be employed with round being preferred mainly due to the ready availability of round tubes which can be utilized with minor modification and the simplicity with regards to formation of seals as will be apparent herein. The length of the lower barrel is chosen to insure that the alignment handle, 4, is sufficiently above the level of stagnant water and the total height of the apparatus is convenient for applying pressure to the force handles, 8, without undue discomfort. Based on determinations of the inventors it is preferred that the lower barrel be at least approximately 6 inches in length to no more than approximately 36 inches in length. More preferably, the lower barrel is at least approximately 18 inches in length to no more than approximately 30 inches in length. A lower barrel of approximately 24 inches in length has been determined to be optimal for most common uses anticipated for the compressed air plunger. The diameter of the lower barrel is chosen to balance strength and convenience of use. A barrel diameter of approximately 1 inch to approximately 5 inches has been determined to be preferable. More preferred is a barrel diameter of approximately 1 inch to approximately 3 inches with a barrel diameter of approximately 2 inches being optimal for most applications anticipated for a compressed air plunger. When a barrel is employed which is not round the diameter is taken as the longest exterior distance straight across the barrel through the central point. For a square barrel, for example, the effective diameter would be the distance between opposing corners. The wall thickness of the lower barrel is chosen for strength and cost and on the material of construction which impacts both strength and cost. It is preferred that the wall thickness be at least approximately 0.010 inches since a smaller wall thickness becomes weak when the preferred materials of construction are employed. It is preferred that the wall thickness be no more than approximately 0.10 inches since the added weight and expense is not justified when the preferred materials of construction are employed. More preferred is a wall thickness of approximately 0.040 inches to approximately 0.060 inches. The material of construction is not limiting except for the constraints of strength and cost. Most preferably the lower barrel is manufactured from plastics, or polymers. A particularly preferred polymer is polyvinylchloride due to cost, availability and weight to strength considerations. Metals may be employed but are not preferred due to factors such as convenience, cost and weight which are not associated with operation of the inventive device but are associated with aesthetics and manufacturing preference. In a particularly preferred embodiment the lower barrel is a round vinyl cylinder with an length of approximately 24 inches, an outer diameter of approximately 2 inches and a wall thickness of approximately 0.05 inches.

In FIG. 5, the upper barrel, 3, is shown as a preferred hollow cylinder. It is most preferred that the upper barrel have the same cross-sectional shape as the lower barrel for manufacturing simplicity. The length of the upper barrel is chosen to insure that sufficient pressure can be applied to the clogged drain. As would be apparent the pressure created is a function of the air displaced by the compressed air plunger. It would also be apparent that the air displaced is directly proportional to the size of the upper barrel, 3. Based on determinations made by the inventors it is preferred that the upper barrel be at least approximately 4 inches in length to no more than approximately 14 inches in length. If the upper barrel is less than approximately 4 inches in length the pressure created is less than that desired. If the barrel is longer than approximately 14 inches the device becomes unwieldy and cumbersome with minimal advantages offered. More preferably, the upper barrel is at least approximately 7 inches in length to no more than approximately 11 inches in length. An upper barrel of approximately 9 inches in length has been determined to be optimal for most common uses anticipated for a compressed air plunger. The inner diameter of the upper barrel is chosen to be slightly larger than the exterior diameter of the lower barrel with enough difference there between to insure an adequate seal. An upper barrel with an internal diameter which is at least approximately 0.05 inches larger than the exterior diameter of the lower barrel is preferred. It is preferred that the upper barrel have an internal diameter which is no more than approximately 1 inch larger than the external diameter of the lower barrel. More preferably the upper barrel has an internal diameter which is at least approximately 0.1 inches larger than the exterior diameter of the lower barrel but no more than approximately 0.7 inches larger than the exterior diameter of the lower barrel. It is most preferred that the upper barrel have an internal diameter which is approximately 0.4 inches larger than the exterior diameter of the lower barrel. The wall thickness of the upper barrel is chosen for strength and cost and on the material of construction which impacts both strength and cost. It is preferred that the wall thickness be at least approximately 0.010 inches since a smaller wall thickness becomes weak when the preferred materials of construction are employed. It is preferred that the wall thickness be no more than approximately 0.10 inches since the added weight and expense is not justified when the preferred materials of construction are employed. More preferred is a wall thickness of approximately 0.040 inches to approximately 0.060 inches. The material of construction is not limiting except for the constraints of strength and cost. Most preferably the upper barrel is manufactured from plastics, or polymers. A particularly preferred polymer is polyvinylchloride due to cost, availability and weight to strength considerations. Metals may be employed but are not preferred due to factors such as convenience, cost and weight and since these factors are not associated with operation of the inventive device. In a particularly preferred embodiment the upper barrel is an approximately 9 inch long round vinyl cylinder with an outer diameter of approximately 2.5 inches and a wall thickness of approximately 0.05 inches.

The optional but preferred alignment handle, 4, is illustrated in FIG. 5 to be formed by a pair of matching alignment handle blanks which are shown in detail in FIGS. 6-8. A preferred alignment handle blank, 15, is shown in perspective view in FIG. 6, in top view in FIG. 7 and in front view in FIG. 8. The alignment handle blank comprises a grip portion, 16, with a collar, 17, integral thereto. When two blanks are brought together in operative contact the grip portion from each blank forms an alignment grip. The grip portion preferably comprises ribs, 18, and a mounting void, 25. The ribs from opposing grip portions add strength to the alignment grip. The mounting voids align for receipt of a mounting element (7 of FIG. 5) such that grip portions are secured one to the other. The collar, 17, comprises a rounded section, 19, within which the lower barrel will be received and tabs, 20, with mounting voids, 21, which align for receiving a mounting element (7 of FIG. 5). The mounting elements draw the two alignment handle blanks into close proximity with the lower barrel which is bound by the rounded sections. The radius of curvature of the rounded sections is chosen such that the lower barrel is secured therein with sufficient friction to prohibit the alignment handle from sliding but not so small as to cause the lower barrel to collapse. The alignment handle is illustrated as a pistol grip since this is preferred for aesthetic purposes. The alignment handle grip may comprise a pistol grip, a round grip, a square grip, or any other shape sufficient to grasp the alignment handle and guide the placement of the compressed air plunger. Since the device can be guided by placing one hand directly on the lower barrel it is understood that the lower alignment handle is a preferred option. The alignment handle may also be integral to the lower barrel as would be common if molded as a single unit. The alignment handle blanks may also be secured one to the other with an adhesive or glue, as would be apparent from the preferred materials. The alignment handle blanks may also be secured to the lower barrel by adhesive.

Figure 9:
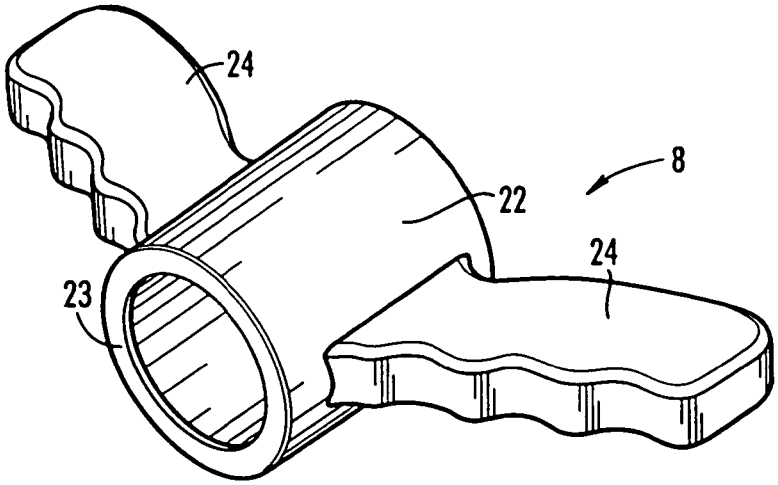
FIG. 9 is a perspective view of a preferred force handle of the present invention.
Figure 10:
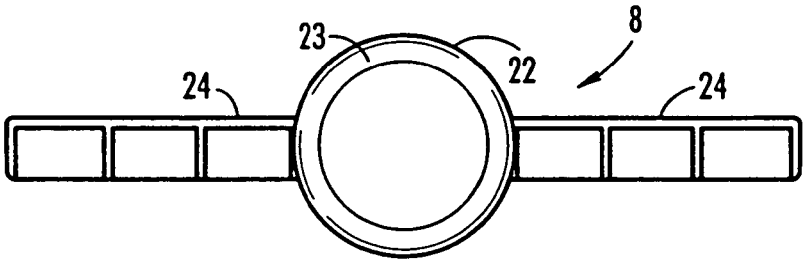
FIG. 10 is a bottom view of the force handle of FIG. 9.
Figure 11:
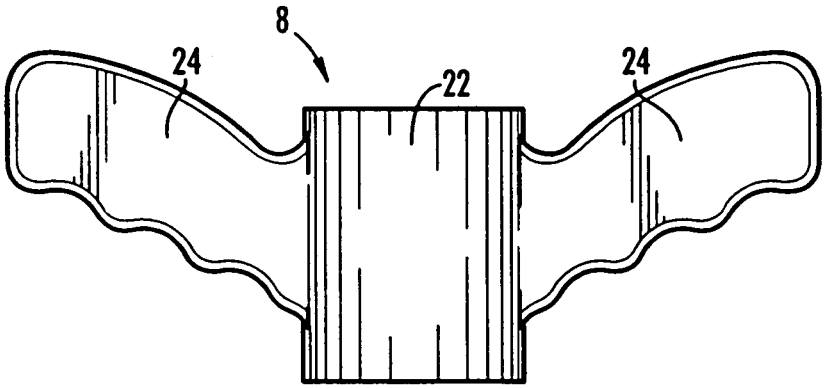
FIG. 11 is a side view of the force handle of FIG. 9.
Figure 12:
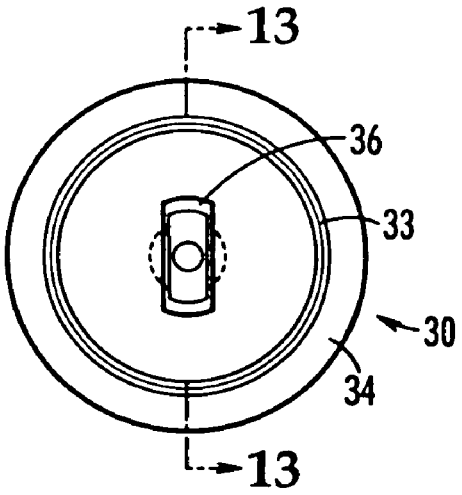
FIG. 12 is a top view of a preferred seal adapter of the present invention.
Figure 13:
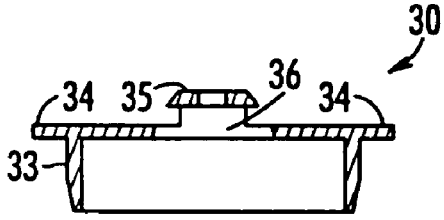
FIG. 13 is a cross-sectional side view of the seal adapter of FIG. 12.
Figure 14:
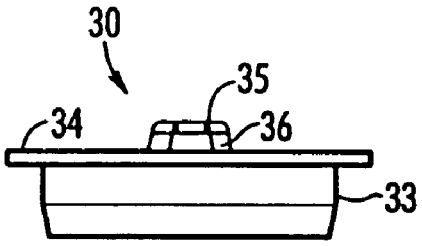
FIG. 14 is a side view of the seal adapter of FIG. 12.
Figure 15:
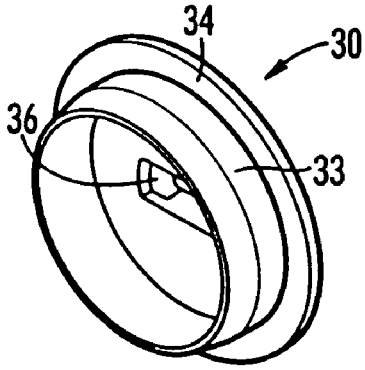
FIG. 15 is a perspective view of the seal adapter of FIG. 12.

The force handle, 8, illustrated in FIG. 5 is shown in detail in FIGS. 9-11. The force handle is shown in perspective view in FIG. 9, in front view in FIG. 10 and side view in FIG. 11. The force handle, 8, comprises a central barrel, 22, with a terminal lip, 23, which creates a restricted portion of the central barrel. The upper barrel, 3, is received in the central barrel and secured therein by glue or other attachment means as known in the art. Integral to the central barrel and symmetrically placed thereon are a pair of handles, 24. The handles are preferably shaped as a pistol grip yet other configurations are within the scope of the present invention including round, square and the like. Pistol grips are preferred for aesthetics and due to the increased control provided.

The upper terminus of the upper barrel is sealed with a cap, 10, as shown in FIG. 5. The cap, 10, is secured to the upper barrel by gluing, or adhesive or by any other methods known in the art for securing a cap to a barrel. It is contemplated that the cap may be integral to the upper barrel as would be realized if the upper barrel were molded with one end sealed.

The seal mechanism is shown in FIG. 5 to comprise two components. A seal adapter, 30, attaches to the upper end, 32, of the lower barrel, 2, and forms an air tight seal there between. The seal adapter will be described in more detail herein. Attached to the seal adapter, 32, is a piston cup, 31, which allows the upper barrel, 3, to slide thereon while maintaining a sealed compartment formed by the lower barrel and upper barrel.

The seal adapter, 30, is shown in detail in FIGS. 12-15. The seal adapter is shown in bottom view in FIG. 12, in cross-sectional view in FIG. 13, in side view in FIG. 14 and perspective view in FIG. 15. The seal adapter, 30, comprises a terminally beveled lip, 33, which is received in the upper end of the lower barrel. The terminal bevel assist in inserting the lip in the lower barrel. The lip is preferably pressed into the upper end of the lower barrel until the stop ledge, 34, contacts the edge of the lower barrel. The stop ledge, 34, is larger than the opening defined by the lip, 23, of the central barrel, 22, of the force grip, 8, illustrated particularly in FIGS. 9 and 10. Therefore, as the force grip is withdrawn to the fully extended position the stop ledge, 34, prohibits the upper barrel from being separated from the lower barrel. The seal adapter, 30, is preferably attached to the lower barrel by glue, or a suitable adhesive, since this method of attachment has the advantages of efficiency and low cost. The seal adapter, 30, has integral thereto a lug, 35, which secures the piston cup as will be realized from further discussions herein. A passage void, 36, allows air to freely pass the seal adapter as the total volume represented by the combined barrels changes as a result of the upper barrel moving up or down relative to the lower barrel.

Figure 16:
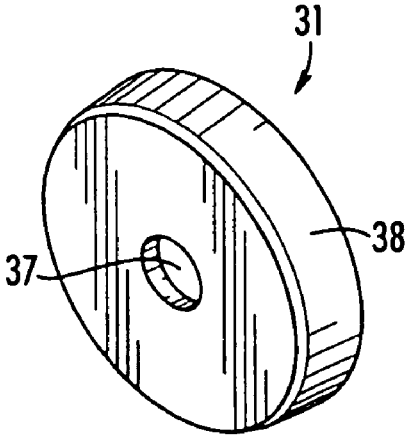
FIG. 16 is top perspective view of a preferred piston cup of the present invention.
Figure 17:
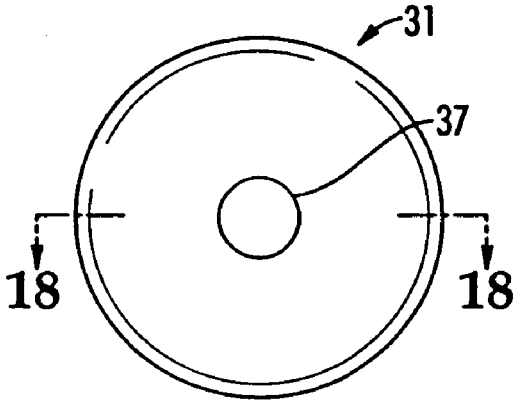
FIG. 17 is a top view of the piston cup of FIG. 16.
Figure 18:
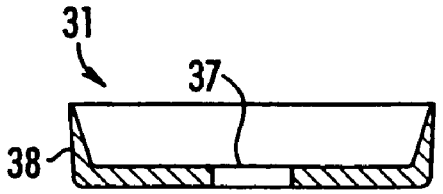
FIG. 18 is a cross-sectional side view of the piston cup of FIG. 16.

The piston cup, 31, is illustrated in detail in FIGS. 16-18. The piston cup, 31, is preferably a flexible member with a central void, 37, which is stretched for receiving the lug, 35, of the seal adapter, 30. The piston cup, 31, comprises a tapered wipe ledge, 38, which slidably engages with the interior wall of the upper barrel to form a seal. The piston cup is preferably manufactured from a pliable material with rubber being most preferred.

Figure 19:
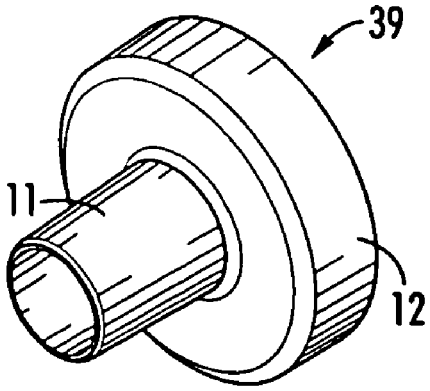
FIG. 19 is a front perspective view of a preferred seal spout of the present invention.
Figure 20:
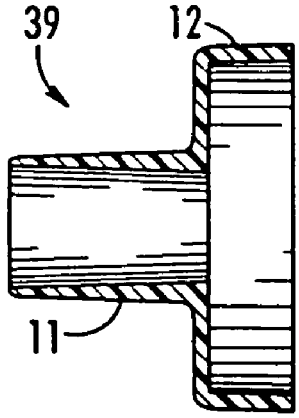
FIG. 20 is a cross-sectional side view of the seal spout of FIG. 19.
Figure 21:
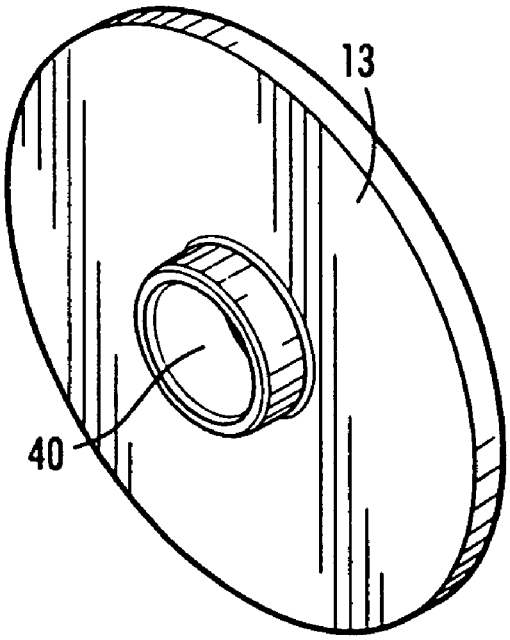
FIG. 21 is a perspective view of a preferred seal disk of the present invention.
Figure 22:
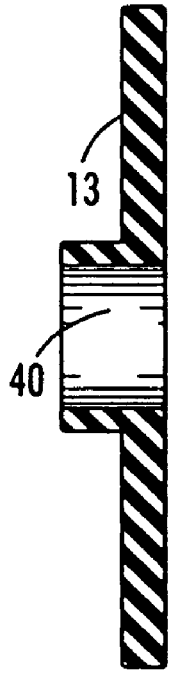
FIG. 22 is a cross-sectional side view of the seal disk of FIG. 21.

A seal spout, 39, of FIG. 5 seals the lower end of the lower barrel, 2, and preferably increases the air flow by restriction relative to the size of the lower barrel. The seal spout is described in more detail with reference to FIGS. 19 and 20. The seal spout, 39, comprises an attachment collar, 12, which is secured to the end of the lower barrel. In one embodiment the attachment collar may be integral to the lower barrel. The spout, 11, has a smaller diameter than the attachment collar, 12. It is preferred that the spout be integral to the attachment collar. In one embodiment the lower barrel, attachment collar and spout are molded as a single unit as would be apparent to one of ordinary skill in the art. The seal spout is preferably manufactured of molded polypropylene. The seal spout comprises a central void and may be tapered to eliminate trapping of spoiled water inside the device. The nozzle allows free passage of fluid, such as water and air through the central void.

A seal disk, 13, receives the spout, 11, and forms a seal between the compressed air plunger and the drain. The seal disk comprises a central void, 40, for receiving the spout, 11. The seal disk is preferably pliable allowing conformance to the shape and contour of the drain entrance. The seal disk is preferably manufactured from a pliable material, most preferably rubber.

Figure 23:
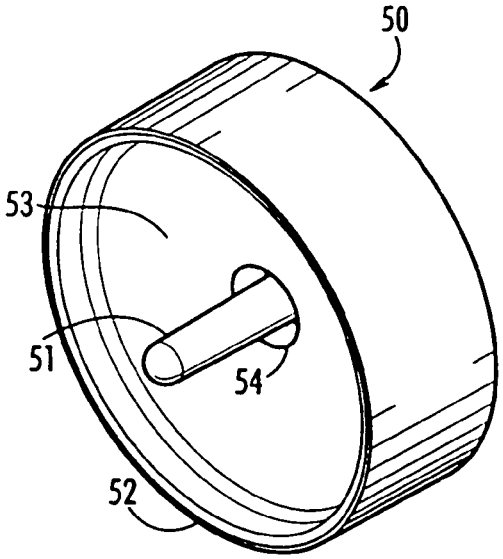
FIG. 23 is a top perspective view of a preferred holder of the present invention.
Figure 24:
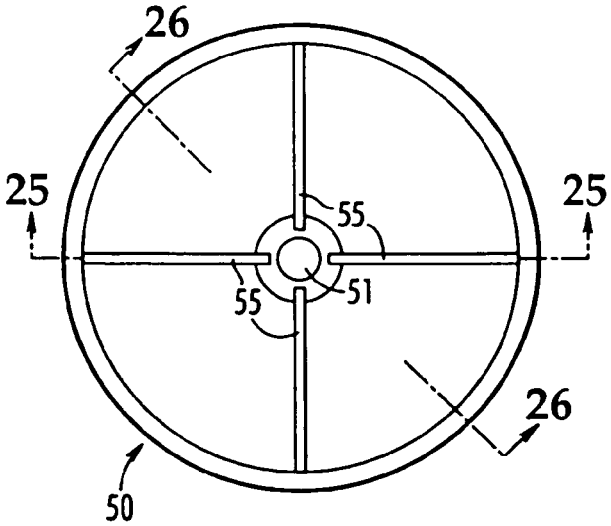
FIG. 24 is a bottom view of the holder of FIG. 23.
Figure 25:
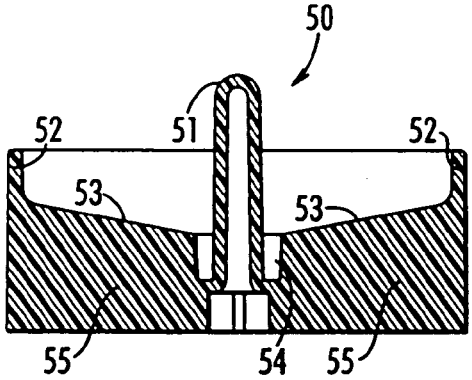
FIG. 25 is a cross-sectional view of the holder taken along line 25-25 of FIG. 24.
Figure 26:
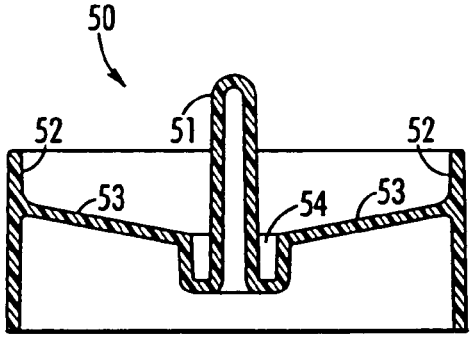
FIG. 26 is a cross-sectional view of the holder taken along line 26-26 of FIG. 24.

A holder, 50, provides a convenient location for storing the compressed air plunger. The holder, 50, will be described in detail by referring to FIGS. 23-26. The holder is shown in perspective view in FIG. 23, in bottom view in FIG. 24 and in cross-sectional views in FIGS. 25 and 26. The holder is shaped primarily like a bowl with a central protrusion, 51, which is received by the nozzle, 11, during storage of the compressed air plunger. The exterior of the holder comprises a wall, 52. The wall insures that any fluid dripping from the compressed air plunger is contained within the holder, 50. The holder further comprises a floor, 53, which preferably slopes downward from the wall towards a central moat, 54. The sloping floor and moat are taken together to increase the volume of dripping water the holder can contain. Below the floor, 53, and integral thereto, are preferred fins, 55, to increase the strength of the holder. The holder is preferably molded as a single element although it is within the scope of the present invention to mold separate elements which are combined to form the holder. It is preferred that the holder be manufactured from a plastic with polypropylene being most preferred.

Figure 27:
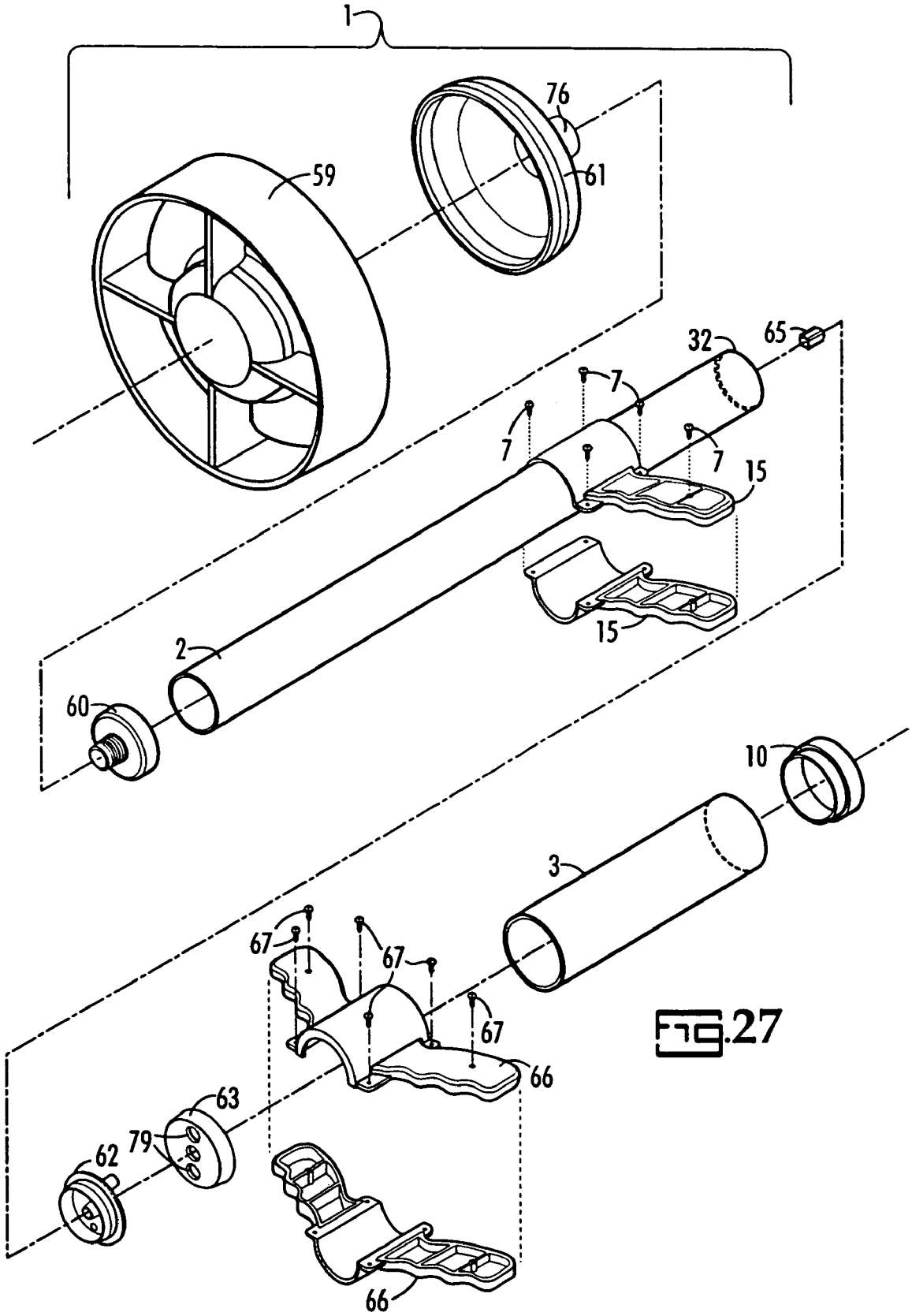
FIG. 27 is an exploded view of an embodiment of the present invention.

An exploded view of a preferred embodiment is provided in FIG. 27. In FIG. 27, the lower barrel, 2, upper barrel, 3, attachment elements, 7, cap, 10, alignment handle blanks, 15, and upper end, 32, are as described previously. A nozzle, 60, is attached to the lower barrel, 2, as previously described. The nozzle receives a force cup, 61. The force cup seals the drain outlet in a manner analogous to a standard plunger. The force cup comprises a passage void, preferably in the attachment neck, 76, to allow air to engage with the drain in accordance with the teachings of the present invention.

A seal adapter, 62, is received by the upper end, 32, of the lower barrel, 2. The seal adapter has, received therein, a float, 65, which allows air to flow from the upper barrel, 3, to the lower barrel, 2. When the compressed air plunger is elongated the float, 65, is drawn into a sealing relationship with the seal adapter, 62, thereby restricting air flow from the lower barrel, 2, to the upper barrel, 3. A piston cup, 63, forms a sliding seal with the interior wall of the upper barrel, 3, as previously described. The piston cup, comprises spacer passages, 79, for receiving spacers which will be further described herein. A pair of matching force grip portions, 66, are secured by securing elements, 67, to form a force grip.

A holder, 59, provides a convenient storage location and collects any drippings from the plunger. The holder will be described in more detail herein.

Figure 28:
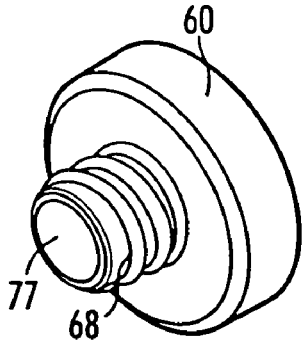
FIG. 28 is a perspective view of a preferred nozzle of the present invention.
Figure 29:
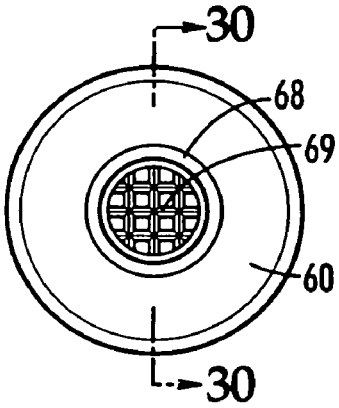
FIG. 29 is a bottom view of the preferred nozzle of FIG. 28.
Figure 30:
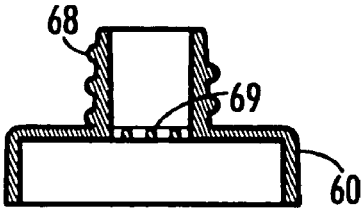
FIG. 30 is a cross-sectional view of the preferred nozzle taken along line 30-30 of FIG. 29.

A preferred seal spout is illustrated in FIGS. 28-30. The seal spout, 60, comprises an externally threaded attachment collar, 68, which are rotatably received by mating threads of a force cup (61 of FIG. 27). The air passage, 77, comprises a grid, 69. The grid, 69, prohibits solid materials from being withdrawn into the lower barrel of the compressed air plunger. The grid is preferably integral to the end cap and molded therein. The grid may also be a separate component which is secured within the air passage, 77, or pinched between the lower barrel and the nozzle.

Figure 31:
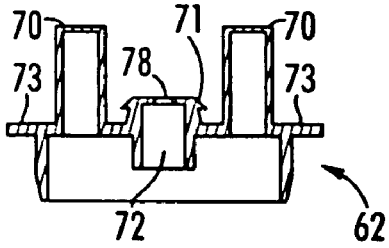
FIG. 31 is a cross-sectional view of a preferred end cap of the present invention.
Figure 32:
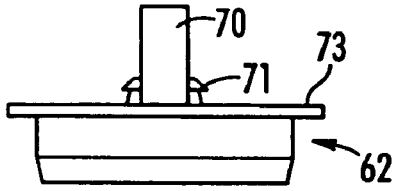
FIG. 32 is a side view of the preferred end cap of FIG. 31.
Figure 33:
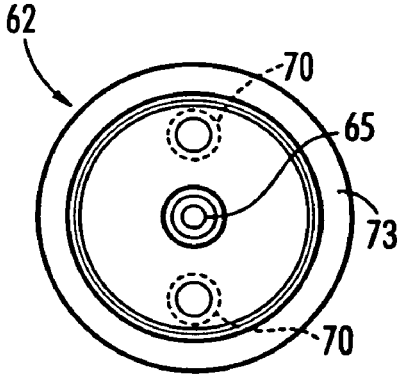
FIG. 33 is a bottom view of the preferred end cap of FIG. 31.

A preferred seal adapter is illustrated in FIGS. 31-33. The seal adapter is shown in cross-sectional view in FIG. 31, in side view in FIG. 32 and bottom view in FIG. 33. The seal adapter, 62, comprises a lip, 73, for prohibiting the ability of the seal adapter to enter into the lower barrel beyond a predetermined distance. A pair of spacers, 70, abut the cap (10 of FIG. 27) when the compressed air plunger is in its shortest configuration. A lug, 71, comprising an air void, 78, allows air to pass through the seal adapter. A passage void, 72, receives a float, 65, which will be describe in more detail in reference to FIGS. 34 and 35. The piston cup (63 of FIG. 27) receives the lug as previously described relative to other embodiments.

Figure 34:
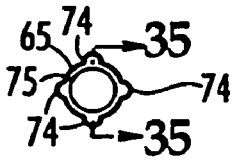
FIG. 34 is a bottom view of a preferred float.
Figure 35:
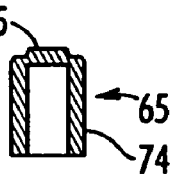
FIG. 35 is a cross-sectional side view of the float taken along line 35-35 of FIG. 34.

A preferred float, 65, is illustrated in FIGS. 34 and 35. The float, 65, is preferably a cylindrical member with flutes, 74. The flutes insure a spacing between the float and the interior walls of the passage void of the seal adapter. The upper extent of the float is a seal, 75. When the compressed air plunger is extended the float is drawn into sealing engagement with the air void, 78, of the seal adapter. When the compressed air plunger is compressed the float drops away from a sealing engagement thereby allowing the free passage of air between the barrels.

Figure 36:
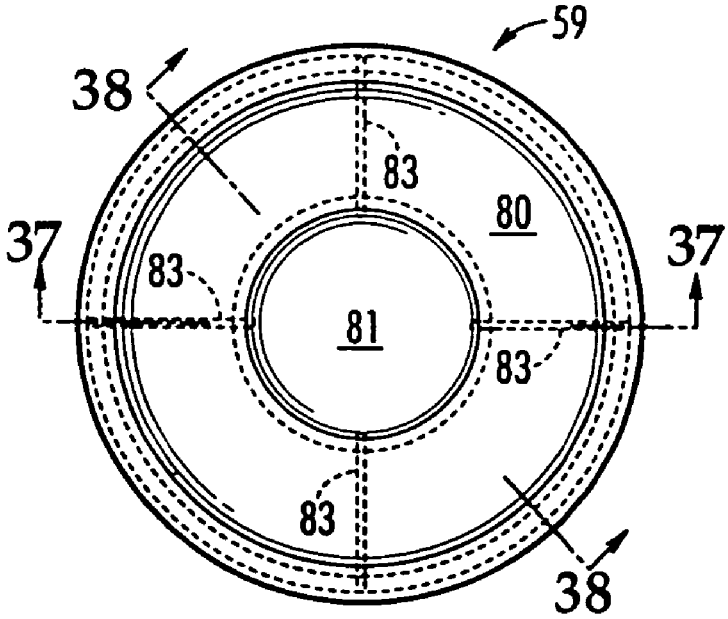
FIG. 36 is a top view of a preferred holder.
Figure 37:
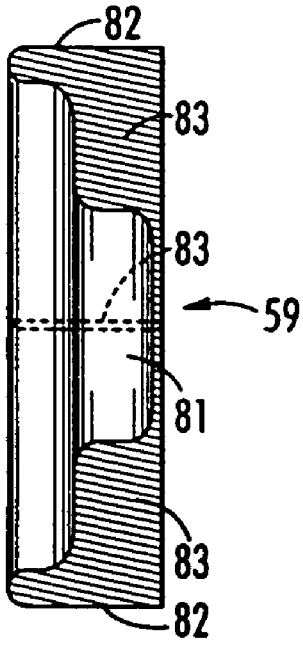
FIG. 37 is a cross-sectional view taken along line 37-37 of FIG. 36.
Figure 38:
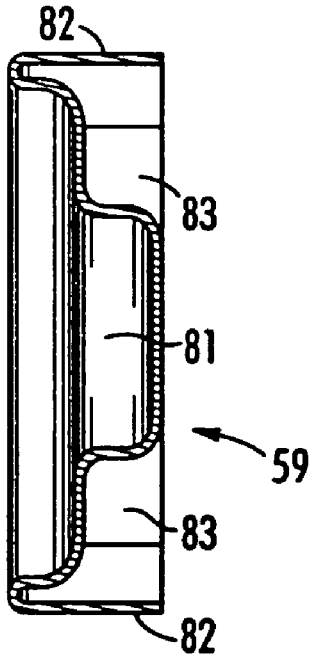
FIG. 38 is a cross-sectional view taken along line 38-38 of FIG. 36.

A preferred holder is illustrated in FIGS. 36-38. The holder, 59, is configured to receive the force cup and to provide a convenient storage location. The holder is preferably rounded with an exterior wall, for support and two interior tiers. The first tier, 80, forms a shelf upon which the force cup rest. The second tier, 81, forms a moat into which drippings from the plunger can be collected. The holder is shown in cross-sectional view in FIG. 37 taken along line 37-37 of FIG. 36. Ribs, 83, provide strength to the holder. The holder is shown in a second cross-sectional view in FIG. 38 taken along line 38-38 of FIG. 36.

Figure 39:
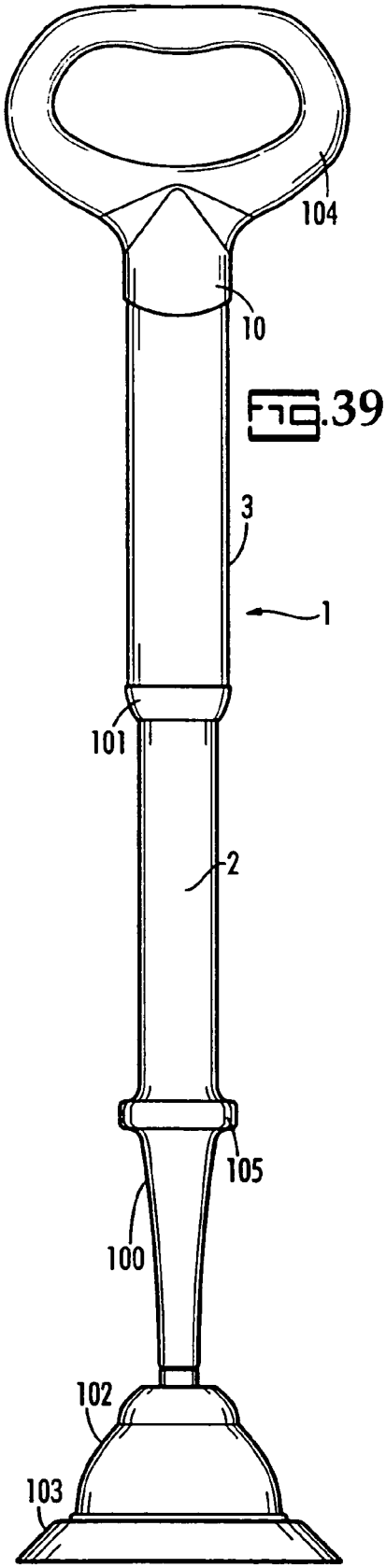
FIG. 39 is a side view of an embodiment of the present invention.

A particularly preferred embodiment is illustrated in FIG. 39. In FIG. 39, the compressed air plunger is generally represented at 1. The lower barrel, 2, and upper barrel, 3, are as described previously herein. Attached to the lower extent of the lower barrel, 2, opposite the upper barrel, 3, is a diverging barrel, 100. The diverging barrel, 100, is preferably frustoconical in shape with the larger end closest to the lower barrel. The diverging barrel restricts the cross-sectional area of the flowing air thereby increasing the pressure at the exit point. The divering barrel is in operational contact with a seal, 102. The preferred seal is a force cup as illustrated. The upper barrel, 3, comprises a cap, 10, for sealing the upper extent of the upper barrel as described previously. The cap has, attached or integral thereto, a handle, 104. As would be realized the handle allows force to be applied to the upper barrel wherein the force is approximately aligned with the central axis of the compressed air plunger. By aligning the handle, and force created thereon, with the central axis the entire device has proven to be safer and more efficient. A base, 103, for storage will be described in more detail herein. A lower grip, 105, which preferably circumscribes the lower barrel preferably at the intersection with the diverging barrel greatly increases the handling of the device. It is most preferred that the lower grip is far enough removed from the lowest most end of the compressed air plunger to be free of contact with fluid in the fixture being unclogged. A collar, 101, between the upper barrel and lower barrel is provided which will be described in more detail herein.

Figure 40:
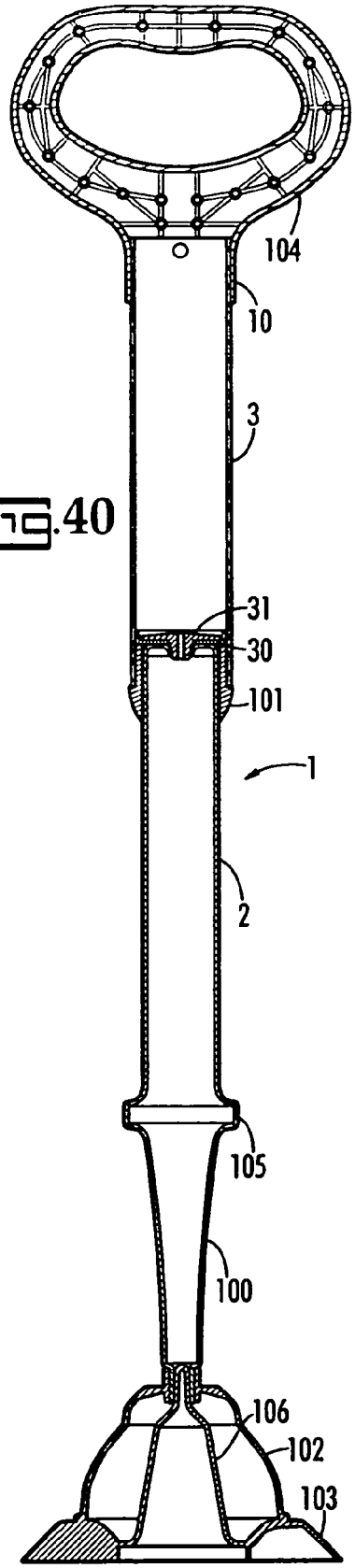
FIG. 40 is a cross-sectional view of the embodiment of FIG. 39.

A cross-sectional view of the embodiment illustrated in FIG. 39 is provided in FIG. 40. In FIG. 40, handle, 104, is illustrated as hollow with internal ribbing for strength. This is a preferred embodiment due to considerations of strength and weight but other configurations could be employed without departing from the invention. The seal adapter, 30, and piston cup, 31, are as described previously. A cylindrical collar, 101, is received by the upper barrel, 3, and circumscribes the lower barrel, 2. The collar preferably extends to the outer extent of the upper barrel to form a smooth transition from upper barrel to lower barrel. This transition minimizes sharp edges and contributes aesthetically to the device. The base, 103, preferably comprises a central post, 106, which is received within the diverging barrel, 100, to stabilize the compressed air plunger.

The upper handle, 104, and cap, 10, may be integral or they may be individual parts secured together in any manner known in the art. Integral construction is preferred due to the minimization of parts and the simplicity of manufacture.

In a particularly preferred embodiment the upper barrel, and elements attached thereto, move from about 8 inches to about 12 inches from fully extended to fully compressed. The Applicants have determined through diligent research that the combination of a frustoconical diverging barrel with a movement of about 10 inches provides an optimal configuration for effective drain clearing and ease of operation. A longer movement may be difficult for many users due to the range of motion required in the arms to apply force over this distance. A shorter movement fails to create enough force to unclog many drains.

Figure 41:
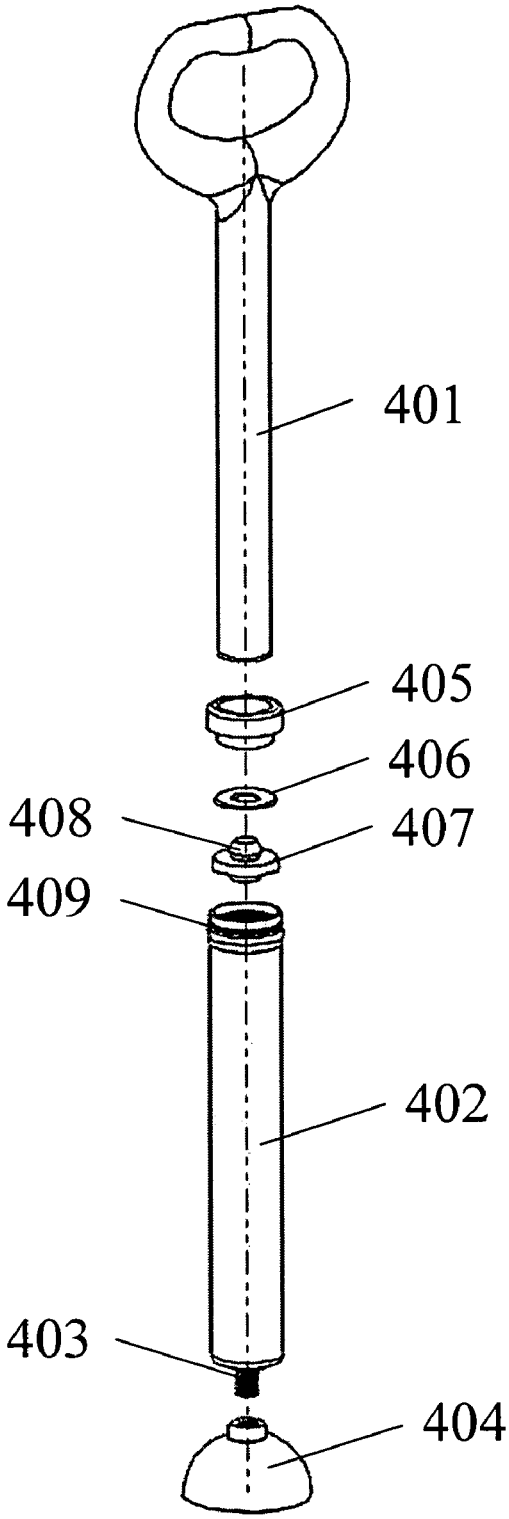
FIG. 41 is an exploded view of an embodiment of the present invention.
Figure 42:
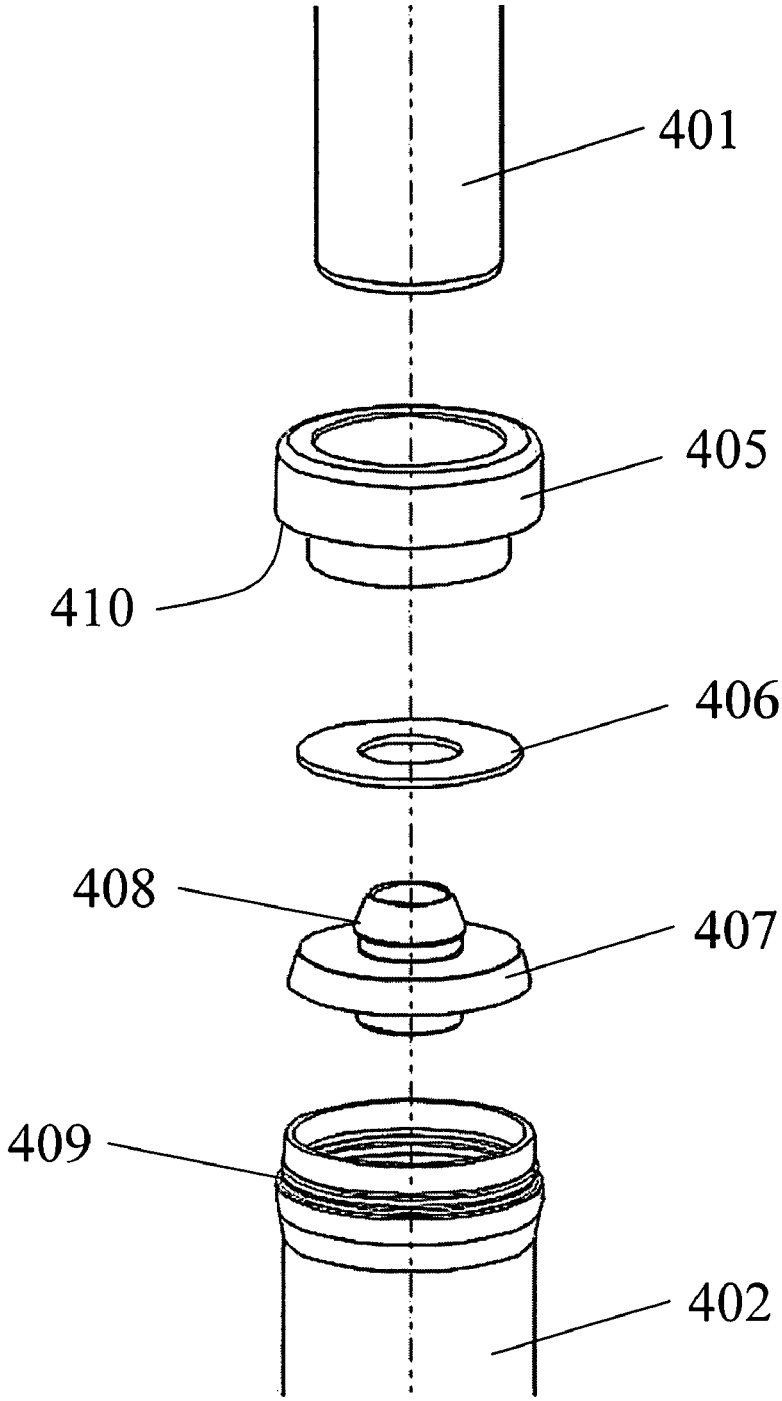
FIG. 42 is partial exploded view of the embodiment of FIG. 41.

A preferred embodiment plunger is illustrated in FIGS. 41 and 42. In FIGS. 41 and 42, the upper barrel, 401, and lower barrel, 402, are slidably engaged with the upper barrel interior to the lower barrel in use. Secured to the lower extent of the upper barrel, preferably by friction fit is a unidirectional seal assembly. The unidirectional seal assembly comprises a unidirectional seal, 407, mounted on a support post, 408, which is forcibly inserted into a void of the upper barrel (not shown). The support post, 408, is specifically shaped to have a bevel and lip such that it can be force fit into a void and only removed with difficulty. A disk, 406, receives the support post, 408, and is situated between the unidirectional seal, 407, and upper barrel, 401. The unidirectional seal, 407, engages with the interior wall of the lower barrel, 402. When the upper tube is drawn away from the lower end of the lower tube the unidirectional seal is sufficiently pliable to flex and disengage with the inner wall of the lower barrel thereby eliminating any pressure decrease in the chamber. It is most preferred that the unidirectional seal be pliable enough that water is drawn up into the lower tube by no more than one inch. It is more preferred that the unidirectional seal be pliable enough that water is drawn up into the lower tube by no more than one-half inch. When the upper tube is forced downward the disk, 406, prohibits the unidirectional seal, 407, from flexing thereby forming an air tight seal between the unidirectional seal, 407, and interior wall of the lower tube.

A stop collar, 405, receives the upper tube, 401, and is preferably threadably engaged with the lower tube, 402, at threads, 409, engaging with a thread receiver, 410. The stop collar, 405, prohibits the two tubes from being separated. The stop collar can also be attached to the lower tube by adhesives, friction fit or any method in the art for attached a collar to a tube.

A plunger bell, 404, is secured to a lower throat, 403, of the lower tube by threads, adhesives or the like.

The unidirectional seal is preferably manufactured from materials with a stiffness of about 55 A to about 90 A durometers as measured in accordance with ASTM D2240. More preferably the unidirectional seal is manufactured from materials with a stiffness of about 60 A to about 80 A durometers as measured in accordance with ASTM D2240. Below about 55 A durometers the unidirectional seal is to flexible and does not form a sufficient seal during compression. Above about 90 A durometers the unidirectional seal is to rigid and incapable of distorting to allow air to flow by during the expansion. If the unidirectional seal is to rigid spoiled water is drawn into the lower tube when the upper tube is withdrawn. A particularly preferred material is Santoprene® 201-70 with a 70 A durometer hardness available from Advanced Elastomer Systems.

A plunger bell, 404, is attached to the lower extend of the plunger, preferably by threads on the lower throat, 403. The plunger bell will be described in more detail further herein.

Figure 43:
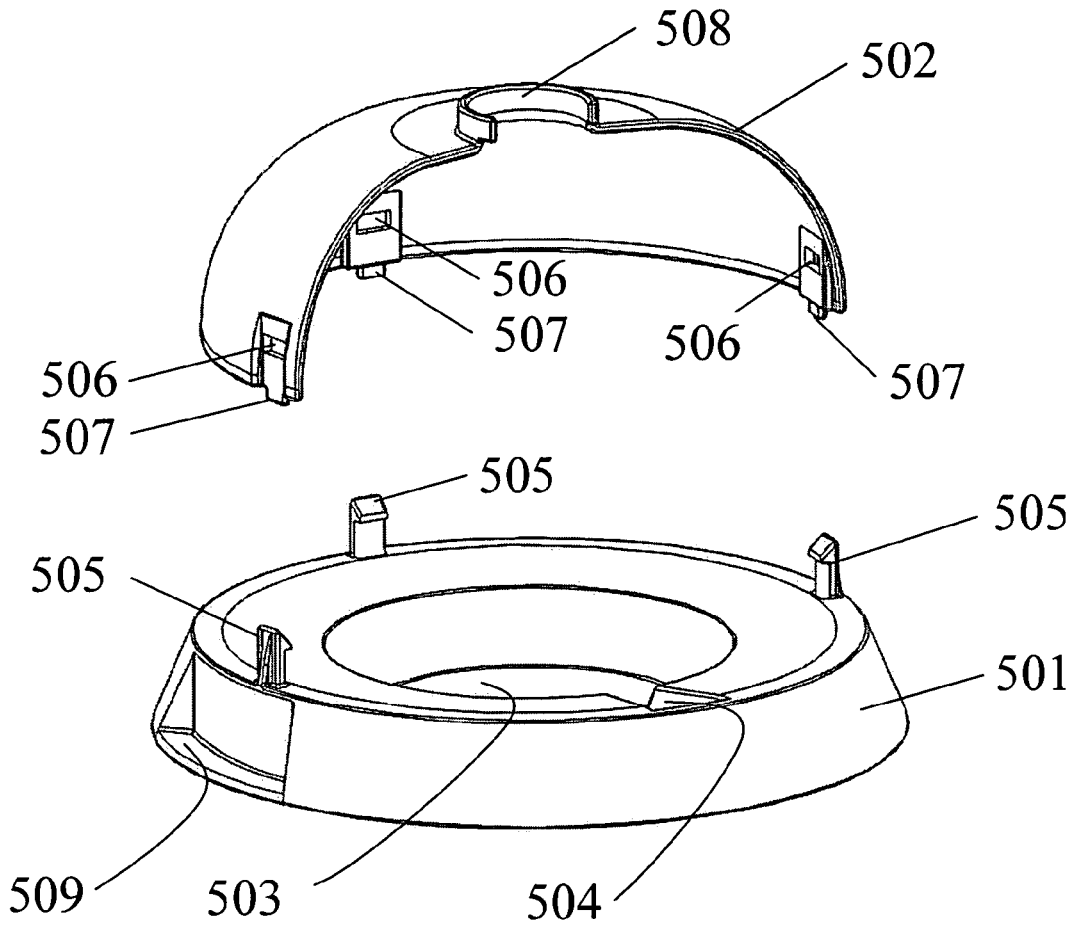
FIG. 43 is an exploded view of a preferred holder of the present invention.
Figure 44:
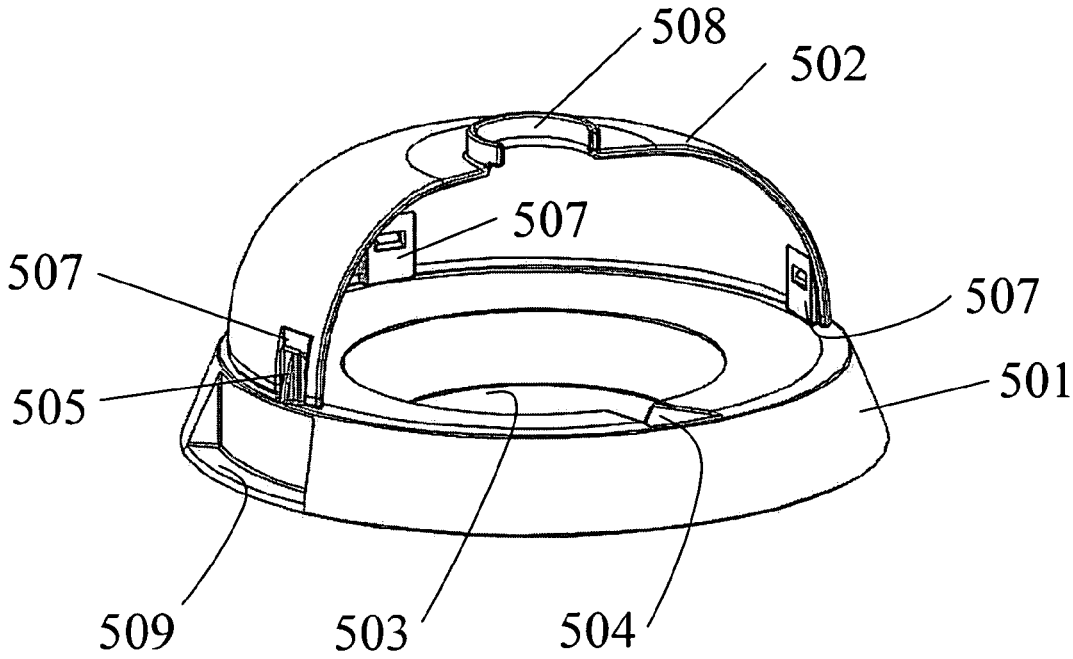
FIG. 44 is a perspective view of the preferred holder of FIG. 43 as viewed when assembled.

A preferred holder is illustrated in exploded perspective view in FIG. 43 and as assembled in perspective view in FIG. 44. The holder has a substantially disk shaped base, 501. A substantially hemispherical top cover, 502, attaches to the base by snap fit wherein a protrusion on stud, 505, mates with a void, 506, in recess, 507. The base, 501, preferably comprises an inwardly angled well, 503, wherein any dripping liquid may be collected. A pour spout, 504, allows any liquid captured in the well to be easily disposed of. A lower recess, 509, provides a location for one to place a foot to stabilize the holder when the plunger is removed and inserted. A semicircular void, 508, receives the lower barrel of the plunger to stabilize the plunger in the holder.

Figure 45:
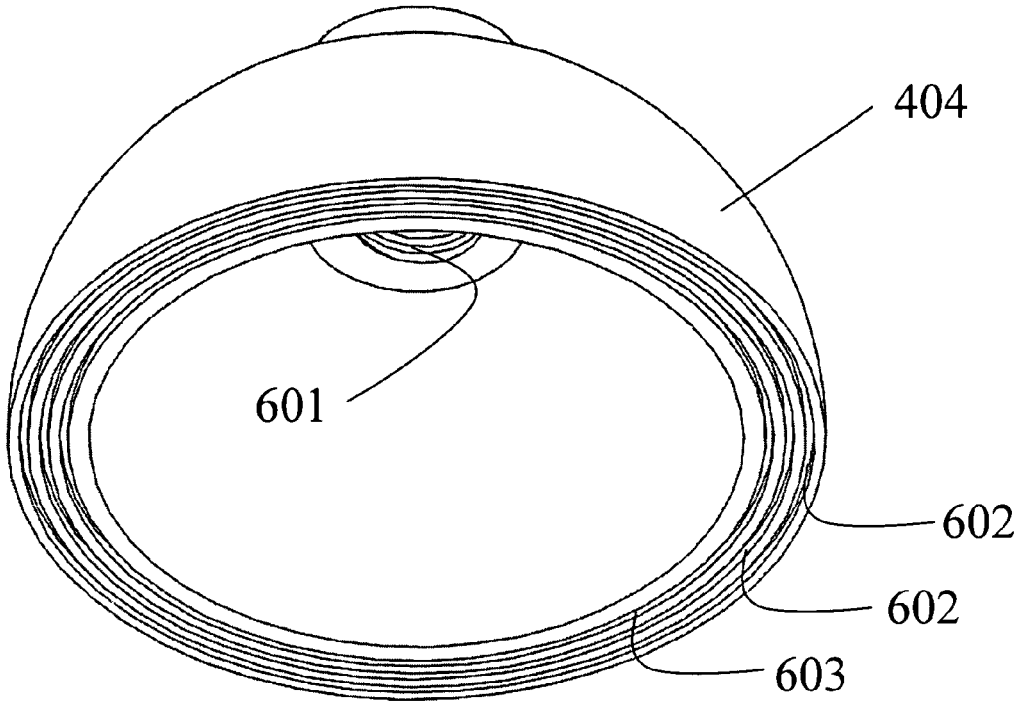
FIG. 45 is a bottom perspective view of a preferred plunger bell of the present invention.

A preferred plunger bell is illustrated in perspective view in FIG. 45. The plunger bell, 404, is substantially cup shaped with an internally threaded collar, 601, for receiving a threaded lower throat of the plunger as shown in FIG. 41. The plunger bell base comprises a base with concentric recesses, 602, with ridges, 603, therebetween. The combination of ridges and recesses improves the seal between the plunger bell and the drain. In a preferred embodiment the plunger bell is manufactured from natural rubber.

The invention has been described with emphasis directed to the preferred embodiments. It would be apparent from the description herein that various embodiments could be developed without departing from the scope of the invention. Alternate methods of construction, operation and use could also be employed without departing from the scope of the invention which is set forth in the claims which follow.

The invention claimed is:

1. An air plunger comprising:

a first barrel;

a second barrel slidably attached to said first barrel;

a unidirectional seal slidably engaged with said first barrel;

a plunger bell attached to said first barrel; and a ledge for prohibiting said second barrel from disassociating with said first barrel.

2. The air plunger of claim 1 wherein said unidirectional seal engages with an inner wall of said first barrel as said second barrel moves towards said plunger bell and disengages with said inner wall of said first barrel when said second barrel moves away from said plunger bell.

3. The air plunger of claim 1 further comprising a support post wherein said unidirectional seal and said second barrel receive said support post.

4. The air plunger of claim 3 further comprising a disk between said unidirectional seal and said second barrel and said disk receives said support post.

5. The air plunger of claim 1 wherein said bell plunger comprises a base with at least one concentric ridge on said base.

6. The air plunger of claim 5 wherein said bell plunger comprises multiple concentric ridges.

7. The air plunger of claim 1 wherein said unidirectional seal allows no more than about one inch of water to be drawn in to said first barrel.

8. The air plunger of claim 7 wherein said unidirectional seal allows no more than about one-half inch of water to be drawn in to said first barrel.

* * * * *